US009804571B2

(12) United States Patent
Lee et al.

(10) Patent No.: US 9,804,571 B2
(45) Date of Patent: Oct. 31, 2017

(54) ACCESSORY ADAPTER SYSTEM FOR WEARABLE COMPUTING DEVICE

(71) Applicant: Wisecrack LLC, Manhattan Beach, CA (US)

(72) Inventors: Jessica Lee, Palo Alto, CA (US); Jonas Lee, Manhattan Beach, CA (US); Jamie Levin, Toronto (CA); Joshua Mendelsohn, Brooklyn, NY (US); David Mozersky, Palo Alto, CA (US); Manning Yuan, Los Altos, CA (US); Leah Pierce, Brooklyn, NY (US)

( * ) Notice: Subject to any disclaimer, the term of this patent is extended or adjusted under 35 U.S.C. 154(b) by 40 days.

(21) Appl. No.: 14/710,748

(22) Filed: May 13, 2015

(65) Prior Publication Data

US 2016/0255923 A1 Sep. 8, 2016

Related U.S. Application Data

(60) Provisional application No. 62/127,201, filed on Mar. 2, 2015.

(51) Int. Cl.

| | |
|---|---|
| ***A44C 5/14*** | (2006.01) |
| ***G04B 47/04*** | (2006.01) |
| ***A44C 25/00*** | (2006.01) |
| *G04B 37/14* | (2006.01) |

(52) U.S. Cl.

CPC ..... *G04B 47/04* (2013.01); *A44C 25/004* (2013.01); *A44C 5/147* (2013.01); *A44D 2203/00* (2013.01); *G04B 37/1486* (2013.01)

(58) Field of Classification Search

CPC ..... A44C 5/14; A44C 5/147; A44C 5/2085; G04B 37/1486; A44B 11/2596; A44B 11/263; F16B 17/00; F16B 2/005; Y10T 24/47; Y10T 24/4782; Y10T 24/4791

USPC ..... 24/265 B, 68 J, 71 J

See application file for complete search history.

(56) References Cited

U.S. PATENT DOCUMENTS

| | | | | | |
|---|---|---|---|---|---|
| 1,160,616 | A | * | 11/1915 | Jeffery et al. | A44C 5/14 224/167 |
| 2,035,931 | A | * | 3/1936 | Vaisey | A44C 19/00 24/265 B |
| 2,035,965 | A | * | 3/1936 | Houghtaling | A44C 19/00 224/180 |
| 2,536,007 | A | * | 12/1950 | Milner | A44C 5/142 16/257 |

(Continued)

*Primary Examiner* — Robert J Sandy
*Assistant Examiner* — Rowland Do
(74) *Attorney, Agent, or Firm* — Chan Hubbard PLLC; Keala Chan

(57) ABSTRACT

A system that transforms the APPLE WATCH®, or a similarly constructed wearable computing device, into a jewelry or wearable accessory that is adaptable to a wide variety of styles. The system includes two pins that are compatible with the device and provide multiple functionalities. The first pin has a bail that effectively turns the device into a pendant or any accessory that is desired, and the second pin has a hinge knuckle onto which other parts—for example a cover, a second bail, or a charm—can attach. When a cover is used, the first pin has the additional functionality of being an attachment point for closure. Both pins maximize unintentional interference with the device and support the device from opposing and/or pulling forces with minimal wear. The pins work in harmony to transform the device into any wearable jewelry the user desires.

13 Claims, 5 Drawing Sheets

(56) References Cited

U.S. PATENT DOCUMENTS

| | | | | | |
|---|---|---|---|---|---|
| 4,052,772 | A * | 10/1977 | Tolfsen | B60R 22/24 | 165/47 |
| 4,664,533 | A * | 5/1987 | Wollman | G04B 37/1486 | 224/164 |
| 5,206,841 | A * | 4/1993 | Boucheron | G04B 37/005 | 368/276 |
| 5,930,873 | A * | 8/1999 | Wyser | A44C 5/14 | 224/178 |
| 6,168,055 | B1 * | 1/2001 | Grados | G04B 37/1486 | 224/152 |
| D606,889 | S * | 12/2009 | Nusbbaumer | D10/39 | |
| D764,347 | S * | 8/2016 | Akana | D11/94 | |
| 2005/0213434 | A1 * | 9/2005 | Epstein | G04B 37/1486 | 368/282 |
| 2005/0217080 | A1 * | 10/2005 | Kojoori | A44B 11/006 | 24/265 WS |
| 2005/0265132 | A1 * | 12/2005 | Ho | A44C 5/14 | 368/282 |
| 2012/0085129 | A1 * | 4/2012 | Kienzle | A44C 5/2042 | 63/12 |
| 2014/0083133 | A1 * | 3/2014 | Lee | A44C 5/14 | 63/3.1 |
| 2015/0055440 | A1 * | 2/2015 | Hembo | G04B 37/1486 | 368/276 |
| 2016/0037877 | A1 * | 2/2016 | Perkins | A44C 5/14 | 224/164 |
| 2016/0040698 | A1 * | 2/2016 | Perkins | A44B 17/0011 | 24/664 |

* cited by examiner

ACCESSORY ADAPTER SYSTEM FOR WEARABLE COMPUTING DEVICE

FIELD OF THE INVENTION

The invention lies in the fields of jewelry, accessories, watches and wearable personal computing devices.

BACKGROUND

The wearability of timepieces is dictated by fashion, usage, and personal style. For instance, the wearable timepiece began as a pendant hanging from a chain around the clock-holder's neck, but has since evolved into the wristwatch. Various conversion kits have been designed to accommodate those who, whether as a matter of style or of necessity, did not want to wear a watch. For instance, Perry U.S. Pat. No. 2,035,979 describes a wrist watch adapter using pintle bars that connect to the watch, while the adapter described by Mix U.S. Pat. No. 2,075,451 uses a strap that attaches to the back of the watch. Often these conversions offer only limited transformations, and do not necessarily fit the style of the watch or the wearer. The challenges of conversion may be likened to those of industrial design and architecture, in which aesthetics and functionality are intertwined.

Apple, Inc., famous for being at the forefront of the intersection between technology and style, now offers an APPLE WATCH® to be worn on the wrist. In fact, electronic devices to be worn on the wrist, and offering functionalities beyond that of a timepiece, have been known for some time. Like watches and other timepieces, they are costly objects of fine engineering, but wearable electronic devices have a few unique features that may inform the development of conversion kits or alternate forms of wearability. Electronic devices are often square or rectangular, and often have a means for user input, such as microphones, buttons, or touchscreens. These features suggest different types of wearability for electronic devices than for watches, and indeed wearability has not yet been fully explored.

SUMMARY OF THE INVENTION

A unique system has been created to transform the APPLE WATCH®, or a similarly constructed wearable computing device, into a jewelry or wearable accessory that is adaptable to a wide variety of styles. The system comprises two pins that are compatible with the device and provide multiple functionalities. The first pin has a bail that effectively turns the device into a pendant, and the second pin has a hinge knuckle onto which other parts—for example a cover, a second bail, or a charm—can attach. When a cover is used, the first pin has the additional functionality of being an attachment point for closure. Both pins maximize unintentional interference with the device and support the device from opposing and/or pulling forces with minimal wear. The pins work in harmony to transform the device into any wearable jewelry the user desires.

DETAILED DESCRIPTION OF THE INVENTION

Figure 1:
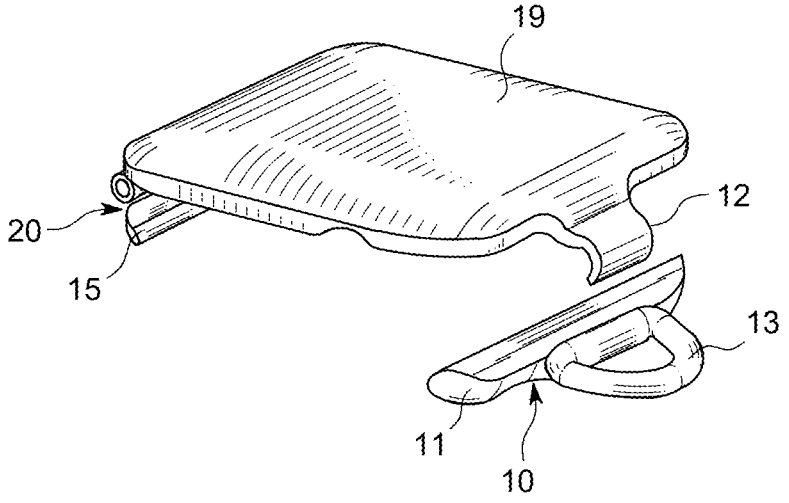
FIG. 1 is front side perspective view of the preferred embodiment of the present invention.
Figure 2:
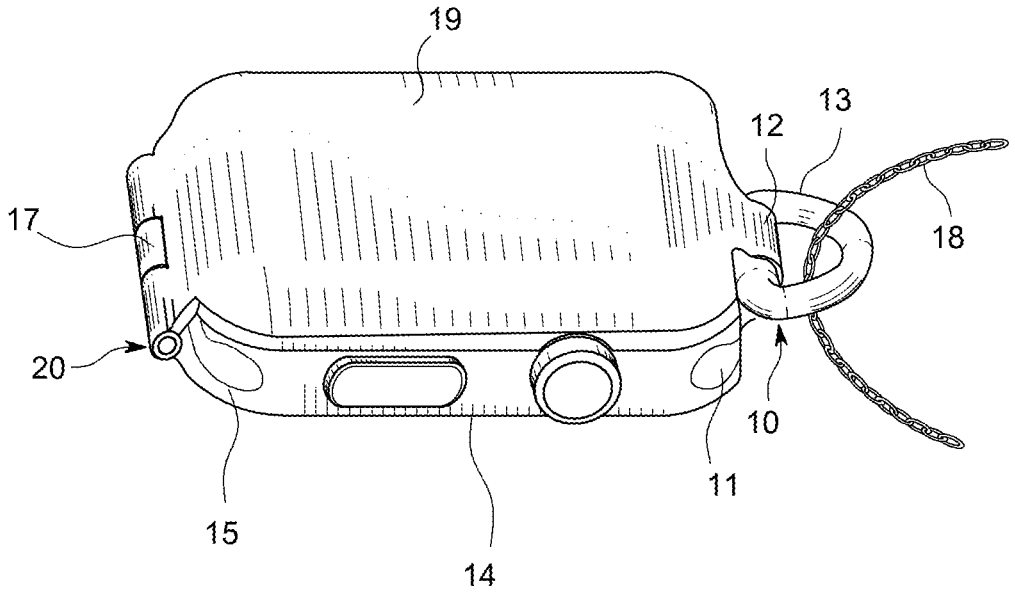
FIG. 2 is front side perspective of the preferred embodiment of the present invention used with a wearable computing device.

FIG. 1 is a front side perspective view of the main parts of the invention. The adapter system of the invention comprises an integrated bail pin 10, an integrated hinge pin 20, and an optional cover 19. Together, the integrated bail pin 10 and integrated hinge pin 20 are interchangeably attachable and removable from an APPLE WATCH® or other similarly constructed electronic device, to convert the electronic device into different wearable accessories. FIG. 2 shows the invention in one environment of use: integrated bail pin 10 and integrated hinge pin 20 with cover 19 are shown attached to an APPLE WATCH® or other similarly constructed electronic device 14, such that via bail 13, the electronic device is adaptable into a pendant, locket, pocketwatch or the like. As such, the invention gives the user not only the ability to transform the electronic device into many different wearable accessories, but also provides the user many different ways of access to the device and its different functionalities. For instance, the user can now access the electronic device's touch screen with one hand while the device hangs from the pocket. Moreover, optional cover 19 protects the face of the electronic device.

Figure 3:
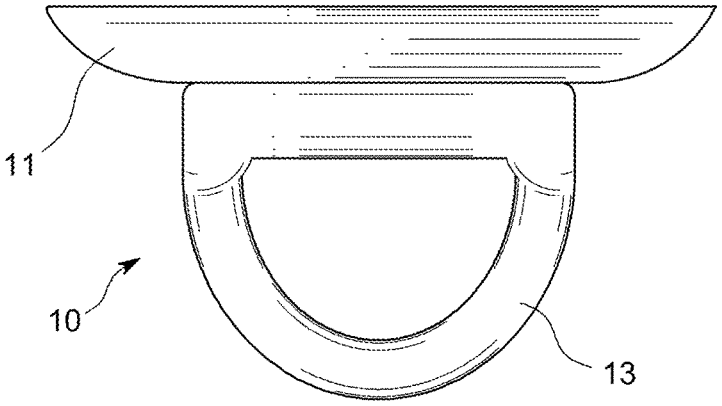
FIG. 3 is a detail front view of the integrated bail pin.
Figure 4:
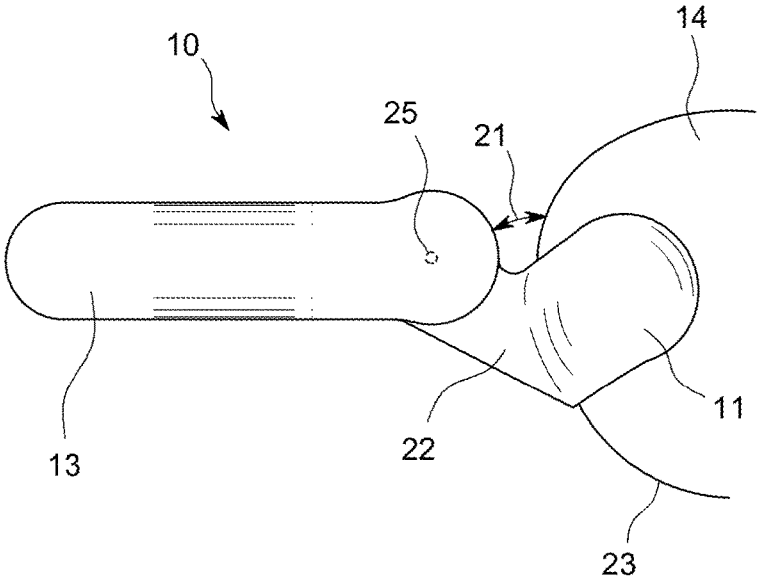
FIG. 4 is a detail side view of the integrated bail pin.

Detail front view of integrated bail pin 10 is shown in FIG. 3. The bail pin comprises a pin 11 that is compatible with the wristpin receiving slot on the APPLE WATCH® or other similarly constructed electronic device, and a bail 13 that enables the device to hang properly from various attachments. Compatibility with the wristpin receiving slot includes, but is not limited to, size compatibility and the means for securing the wristpin within the slot, such as by magnets or detents. As shown in detail side view in FIG. 4, in which the integrated bail pin 10 is shown inserted into APPLE WATCH® or similarly constructed electronic device 14, the bail pin is of rigid construction without moving parts such that when pin 11 is inserted into the wristpin receiving slot of the device there are no degrees of freedom for the bail pin 10, a fixed distance 21 of approximately 0.5 mm. between bail 13 and device 14 prevents interference and/or wear on the side of the device, and cantilever 22, which connects the bail 13 and the pin 11, is angled to maximize cross-section and therefore support, while also following the surface contour of the side 23 of the device. Under this construction, bail 13 comprises a fixed datum onto which a variety of attachments and accessories can subsequently be built. It will also be noted that midpoint 25 of the base of the bail 13 is in line with the center of the device, for balance and reduction of strain. In the case of the APPLE WATCH®, the device will be offered in two sizes, 38 mm. and 42 mm. When measured from the center of the trapezoid, the pin 11 may therefore be 27 mm. and 31 mm. long, respectively, and it should be contoured to follow the surface of the device. The length of the base of the bail may therefore be at least 10.9 mm. and 12.7 mm., respectively. The bail is therefore long enough to both support the device with minimal prying and to enable the opening and closing of clasp 12, which hooks over its base.

Figure 5:
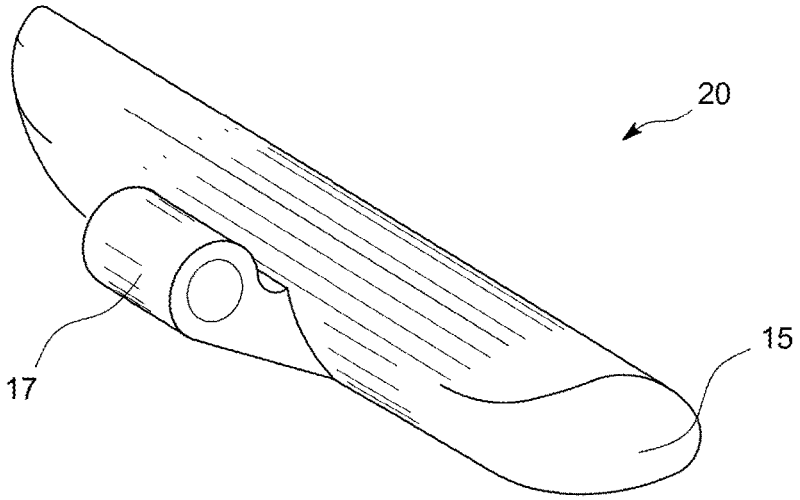
FIG. 5 is a detail perspective view of the hinge knuckle pin.
Figure 6:
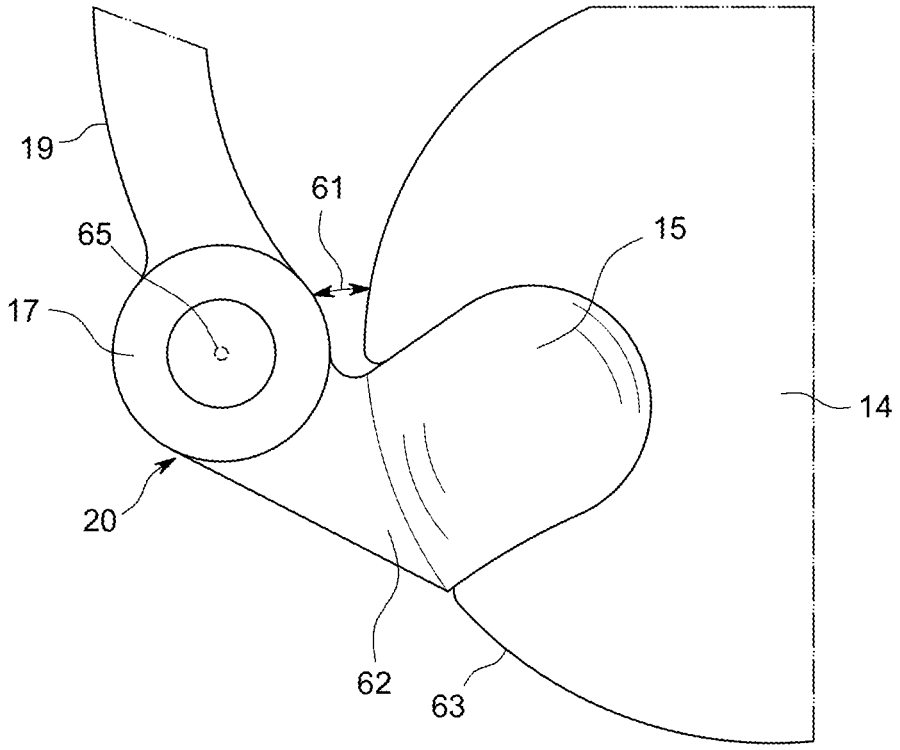
FIG. 6 is a detail side view of the hinge knuckle pin used with a wearable computing device.
Figure 7:
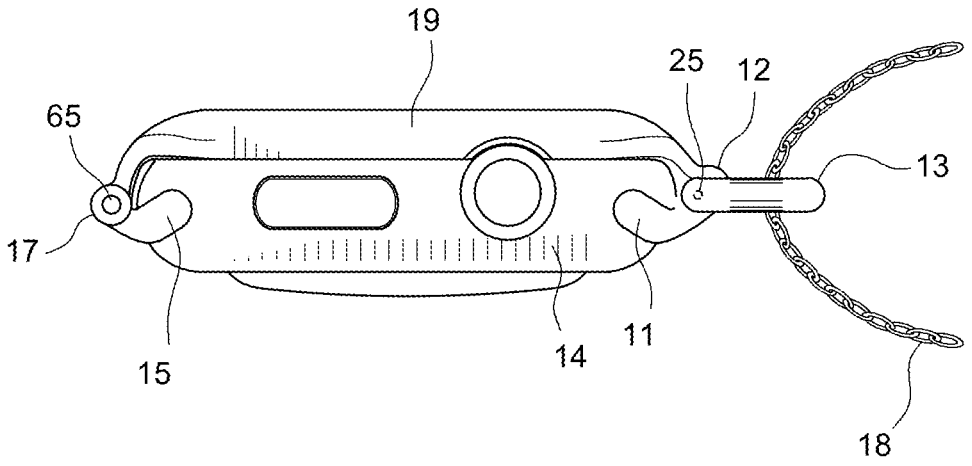
FIG. 7 is a side view of the preferred embodiment of the present invention used with a wearable computing device.

Detail perspective view of hinge pin 20 is shown in FIG. 5. The hinge pin comprises a pin 15 that is compatible with the wristpin receiving slot on the APPLE WATCH® or other similarly constructed electronic device, and a hinge knuckle 17 to which can attach a standard hinge or various other attachments. Compatibility with the wristpin receiving slot includes, but is not limited to, size compatibility and the means for securing the wristpin within the slot, such as by magnets or detents. As shown in detail side view in FIG. 6, in which the integrated hinge pin 20 is shown inserted into Apple Watch™ 14, the hinge pin is of rigid construction without moving parts such that when pin 15 is inserted into the wristpin receiving slot of the device there are no degrees of freedom for the hinge pin 20, a fixed distance 61 of approximately 0.5 mm. between hinge knuckle 17 and device 14 prevents interference and/or wear on the side of the device, and cantilever 62, which connects the knuckle 17 and the pin 15, is angled to maximize cross-section and therefore support, while also following the surface contour of the side 63 of the device. Under this construction, hinge knuckle 17 comprises a fixed datum onto which a variety of attachments and accessories can subsequently be built. It will also be noted that midpoint 65 of the hinge knuckle 65 is in line with the center of the device, for balance and reduction of strain. When measured from the center of the trapezoid, the pin 15 may therefore be 27 mm. and 31 mm. long, respectively, to fit the two versions of the APPLE WATCH®, and it should be contoured to follow the surface of the device. Thus, integrated hinge pin 20 and integrated bail pin 10 have roughly symmetrical requirements as pertaining to their mechanical interaction with the APPLE WATCH® or other similarly constructed electronic device. As can be seen in FIG. 7, the center points 65 and 25 of the hinge knuckle and the base of the bail are aligned along the center of the device, for optimal stability and balance.

Figure 8:
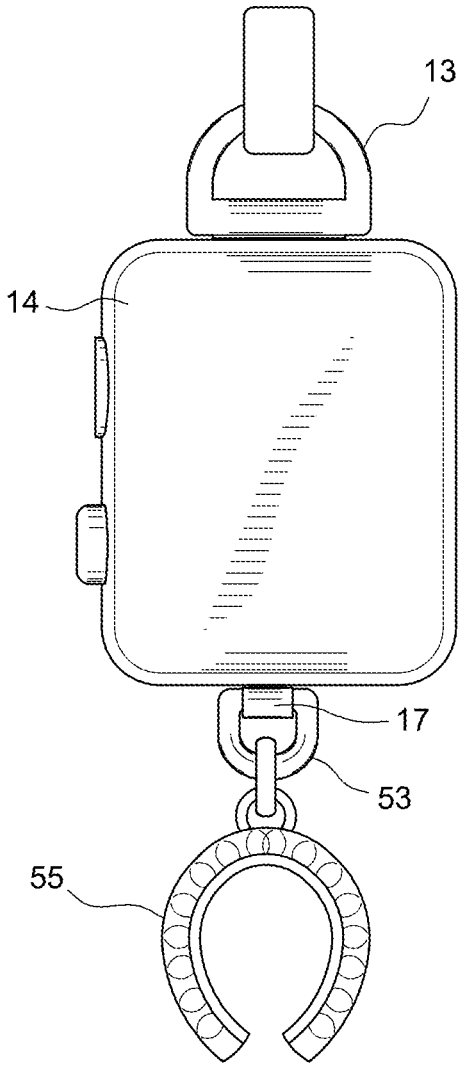
FIG. 8 is a front view of an alternative use of the present invention used with a wearable computing device.

The integrated hinge pin enables the attachment of a hinged cover and/or a variety of other attachments. A side view of the invention being used with the APPLE WATCH® or similarly constructed electronic device with cover 19 attached to hinge pin 15 is shown in FIG. 7. Any hinged cover fitting the dimensions of the device may be used, and in the preferred embodiment a lip of the cover falls over the side of the device. The cover may be closeable by any means but in the preferred embodiment comprises a clasp 12 that hooks over the base of bail 13. The cover may be decorative, in keeping with an objective of the invention to facilitate personal style. The integrated hinge pin also serves as an attachment point for other attachments, including a bail 53 as shown in FIG. 8 being used to hang a decorative charm 55.

The invention enables multiple combinations and uses of the integrated bail pin and integrated hinge pin. As noted above, bail 13 and hinge knuckle 17 are fixed datum off of which other accessories may be flexibly built. The bail pin and hinge pin also work in harmony, allowing the user to play with alternate definitions of wearability for the electronic device. The electronic device may be converted into a pocket watch, a pendant, a carry locket, etc. . . . . It may even be worn as a bracelet, by attaching the bail pin on both sides of the device. The system is fully personalizable and there are no limitations on combinations and use.

What is claimed is:

1. An adapter system for an electronic device having a wristpin receiving slot, comprising:

a first bail pin comprising a first pin compatible with the wristpin receiving slot on the electronic device, a first bail defining a first fixed datum attached to a first accessory attachment and receiving a closer of a cover, and a first cantilever anchored to the electronic device by the first pin, wherein the first cantilever supports the first bail at a first distance from the electronic device sufficient to prevent interference with the electronic device; and a hinge pin comprising a second pin compatible with the wristpin receiving slot on the electronic device, a hinge knuckle defining a second fixed datum attached to the cover attached to the hinge knuckle, and a second cantilever anchored to the electronic device by the second pin, wherein the second cantilever supports the hinge knuckle at a second distance from the electronic device sufficient to prevent interference with the electronic device.

2. The system of claim 1 wherein the first accessory attachment is a necklace.

3. The system of claim 1 wherein the first accessory attachment is a chain.

4. The system of claim 1 wherein the first bail has a length of 10.9 mm. or 12.7 mm.

5. The system of claim 1 wherein the first and the second distances from the electronic device sufficient to prevent interference with the electronic device are each 0.5 mm.

6. The system of claim 1 wherein the cover is magnetic.

7. The system of claim 1 wherein the hinge knuckle receives a second accessory attachment.

8. The system of claim 7 wherein the second accessory attachment is a charm.

9. An adapter system for an electronic device having a wristpin receiving slot, comprising:

a first bail pin comprising a first pin compatible with the wristpin receiving slot on the electronic device, a first bail defining a first fixed datum attached to a first accessory attachment, and a first cantilever anchored to the electronic device by the first pin, wherein the first cantilever supports the first bail at a first distance from the electronic device sufficient to prevent interference with the electronic device; and a second bail pin comprising a second pin compatible with the wristpin receiving slot on the electronic device, a second bail defining a second fixed datum attached to a second accessory attachment, and a second cantilever anchored to the electronic device by the second pin, wherein the second cantilever supports the second bail at a second distance from the electronic device sufficient to prevent interference with the electronic device.

10. The system of claim 9 wherein the first accessory attachment is a necklace.

11. The system of claim 9 wherein the second accessory attachment is a charm.

12. The system of claim 9 wherein the first bail and the second bail each have a length of 10.9 mm. or 12.7 mm.

13. The system of claim 9 wherein the first and the second distances from the electronic device sufficient to prevent interference with the electronic device are each 0.5 mm.

* * * * *